US009129739B2

(12) United States Patent
Xu et al.

(10) Patent No.: US 9,129,739 B2
(45) **Date of Patent: *Sep. 8, 2015**

(54) RESIN-MOLDED STEREO WOUND-CORE DRY-TYPE AMORPHOUS ALLOY TRANSFORMER

(75) Inventors: Kaixuan Xu, Kaiping (CN); Xianqing Guo, Kaiping (CN)

(73) Assignee: HAIHONG ELECTRIC CO., LTD, Kaiping, Guangdong Province (CN)

( * ) Notice: Subject to any disclaimer, the term of this patent is extended or adjusted under 35 U.S.C. 154(b) by 2 days.
This patent is subject to a terminal disclaimer.

(21) Appl. No.: 13/696,395

(22) PCT Filed: Oct. 31, 2011

(86) PCT No.: PCT/CN2011/081587
§ 371 (c)(1),
(2), (4) Date: Sep. 17, 2013

(87) PCT Pub. No.: WO2012/163036
PCT Pub. Date: Dec. 6, 2012

(65) Prior Publication Data

US 2014/0002229 A1 Jan. 2, 2014

(30) Foreign Application Priority Data

May 27, 2011 (CN) ..... 2011 1 0139968

(51) Int. Cl.
*H01F 27/26* (2006.01)
*H01F 5/04* (2006.01)
(Continued)

(52) U.S. Cl.
CPC ..... *H01F 30/08* (2013.01); *H01F 27/263* (2013.01); *H01F 30/12* (2013.01); *H01F 2027/328* (2013.01)

(58) Field of Classification Search
CPC ..... H01F 27/022; H01F 41/0226; H01F 41/0005; H01F 41/127; H01F 27/322
USPC ..... 336/5, 210, 221, 222, 234, 65, 67, 68, 336/212, 219; 29/602.1, 605, 606
See application file for complete search history.

(56) References Cited

U.S. PATENT DOCUMENTS 3,234,493 A * 2/1966 Zwelling et al. ..... 336/94
3,243,744 A * 3/1966 Halacsy ..... 336/61
(Continued)

FOREIGN PATENT DOCUMENTS

CN 201259817 Y 6/2009
CN 201402716 Y 2/2010
CN 201478091 U 5/2010

OTHER PUBLICATIONS

International Search Report of the International Searching Authority mailed on Mar. 15, 2012 from counterpart International Application No. PCT/CN2011/081587, filed Oct. 31, 2011.
(Continued)

*Primary Examiner* — Alexander Talpalatski
*Assistant Examiner* — Joselito Baisa
(74) *Attorney, Agent, or Firm* — Loginov & Associates, PLLC; William A. Loginov

(57) ABSTRACT

The patent discloses a resin-molded stereo wound-core dry-type amorphous alloy transformer, belonging to the field of power equipment. The resin-molded stereo wound-core dry-type amorphous alloy transformer disclosed is characterized in its stereo wound-core structure. Three lower yokes are provided on a welded base of a lower clamp, and an upper clamp and a lower clamp are connected with each other by press screws. Its low-voltage windings are with a foil-wound or cylindrical structure, while its high-voltage windings are wound with oxygen-free copper wires wrapped in NOMEX® paper and processed through vacuum pressure impregnation. In addition, several upper and lower padding blocks are involved to support and compress the high-voltage and low-voltage windings, so that the product is formed in a rigid stereo frame structure.

3 Claims, 6 Drawing Sheets

(51) Int. Cl.

| | |
|---|---|
| ***H01F 27/28*** | (2006.01) |
| ***H01F 27/24*** | (2006.01) |
| ***H01F 30/08*** | (2006.01) |
| ***H01F 30/12*** | (2006.01) |
| *H01F 27/32* | (2006.01) |

(56) References Cited

U.S. PATENT DOCUMENTS

| | | | | | |
|---|---|---|---|---|---|
| 3,371,299 | A * | 2/1968 | Radkowski et al. | ..... | 336/57 |
| 3,474,369 | A * | 10/1969 | Keogh | ..... | 336/65 |
| 3,504,319 | A * | 3/1970 | Leonard | ..... | 336/68 |
| 6,160,464 | A * | 12/2000 | Clarke et al. | ..... | 336/60 |
| 6,411,188 | B1 * | 6/2002 | Pruess et al. | ..... | 336/96 |
| 8,659,382 | B2 * | 2/2014 | Xu et al. | ..... | 336/196 |

OTHER PUBLICATIONS

International Preliminary Report on Patentability mailed on Dec. 2, 2013 from counterpart International Application No. PCT/CN2011/081587, filed Oct. 31, 2011.

* cited by examiner

RESIN-MOLDED STEREO WOUND-CORE DRY-TYPE AMORPHOUS ALLOY TRANSFORMER

TECHNICAL FIELD

This invention is in the field of power equipment, and particularly relates to a resin-molded stereo wound-core dry-type amorphous alloy transformer.

BACKGROUND

There are some great advantages in transformer energy saving, environment protection and operation cost for the conventional dry-type amorphous alloy transformers. Specifically, their no-load loss is 60%~70% lower than the 10-type series transformers', their operation fee is low and their overall economic efficiency is high. However, because of their thin thickness, great sensitivity to mechanical stress, sensitive magnetostriction performance, low saturation magnetic flux density, and the rectangle-shape structure of their core pillars and windings, two major defects exist with the conventional dry-type amorphous alloy transformers, including higher noise level and weaker short-circuit withstanding ability.

THE SUMMARY OF THE INVENTION

The aim of this invention is to provide a resin-molded stereo wound-core dry-type amorphous alloy transformer, which can reduce the working noise and raise the ability of short-circuit withstanding.

The invention is realized through the following technical solution: the resin-molded stereo wound-core dry type amorphous alloy transformer comprises a clamp, a core and a winding; wherein the winding consists of three phase windings wound on three core pillars of the core, each phase winding consists of a high-voltage winding and a low-voltage winding; the clamp comprises an upper camp, a lower clamp, an upper pressing board, a lower pressing board and a plurality of pressing screws. The transformer is characterized in that: the core consists of three amorphous alloy made single frames which are arranged annularly and every two adjacent of which are fixedly connected, the cross section of the vertical and horizontal sides of the single frames are in a semi-circular or semi-regular-polygonal shape; the horizontal sides of the single frames form yokes, the vertical sides of every two adjacent single frames are pieced together to form a core pillar, the cross section of the core pillars is in an approximately circular or regular-polygonal shape.

The lower pressing board is fixedly connected with a base of the lower clamp through a supporting rod, the upper and lower pressing boards are cooperated with the pressing screws; the upper pressing board is located on the top of the core, while the lower pressing board is on the bottom of the core.

The yokes on the upper end of the core are arranged between a side of the upper pressing board and a side of the upper clamp, the yokes on the lower end of the core are arranged on the base located between the lower pressing board and lower clamp.

The high-voltage and low-voltage windings are arranged on the core pillars, the upper and lower clamps clamp the windings.

The clamp further comprises upper padding blocks and lower padding blocks.

The upper padding blocks and lower padding blocks are arranged on the two ends of the high-voltage and low-voltage windings, respectively; the lower clamp and the lower pressing board are configured to support the lower padding blocks, while the upper clamp and the upper pressing board are configured to compress the upper padding blocks.

The low-voltage windings are with a foil-wound or wire-wound cylindrical structure, in which the epoxy resin mixture is used for end sealing and isolation.

The high-voltage windings are with a sectional-type cylindrical structure, and the windings are entirely encapsulated with a solid epoxy resin layer.

The transformer further comprises three connecting terminals for the high-voltage windings and four connecting terminals for the low-voltage, which are arranged on the installation stands of the upper clamp at the opposite sides of the transformer, respectively.

The transformer further comprises an insulation pad arranged between the yokes and the base.

The invention discloses a resin-molded stereo wound-core dry-type amorphous alloy transformer, combining the advantages of both the resin-molded stereo wound-core dry-type transformers and the dry-type amorphous alloy transformers. The core of the transformer disclosed herein has a stereo wound-core structure, and consists of three single frames with a semi-circular cross section and made with several trapezium amorphous alloy strips wound in sequence, wherein every two single frames with a semi-circular cross section can be combined into a core pillar with an approximately circular cross section. The amorphous alloy sheets are wound closely, the magnetic conduction direction of which is in line with the magnetic circuit direction of the core. The working vibration is thus small and the noise caused by the laminated core magnetic circuit incoherence is reduced. Furthermore, the high energy consuming and weak areas in the core caused by the conventional amorphous ally core assembly and disassembly are avoided. Furthermore again, the amorphous alloy made core with a stereo structure adopted in the invention can save more amorphous alloy materials, reduce the core weight and decrease the no-load loss and no-load current of the transformer during operation. At last, the windings of the transformer according to the invention can be produced in a standard circular shape, so that the force may be evenly distributed on the winding conductors circumferentially, the ability to withstand short circuit is thus enhanced.

DESCRIPTION OF THE EMBODIMENTS

Detailed descriptions for the embodiments of the invention will be made with reference to the drawings.

Figure 1:
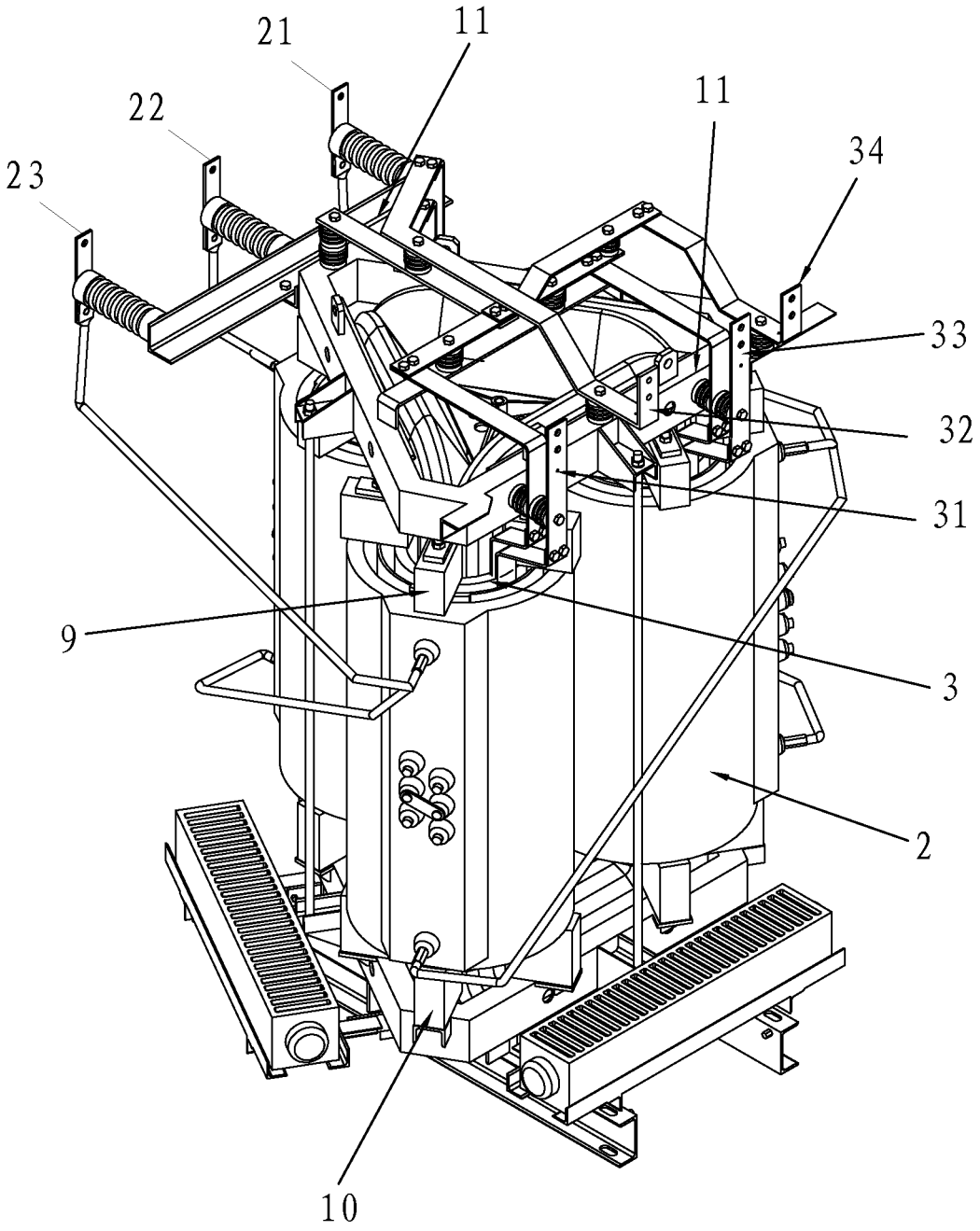
FIG. 1 is a spatial view of the invention.
Figure 2:
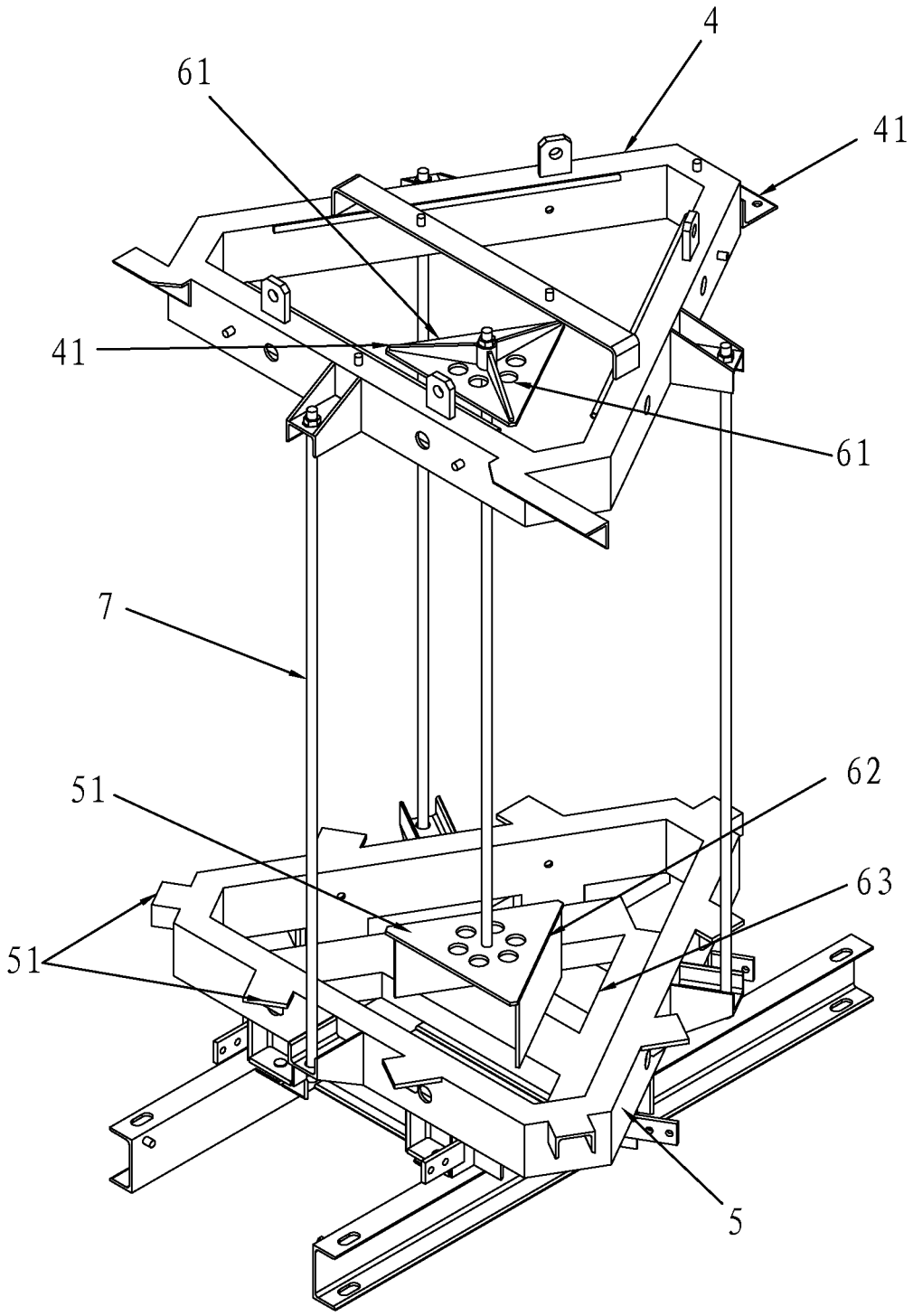
FIG. 2 is spatial view of clamp according to the invention.
Figure 3:
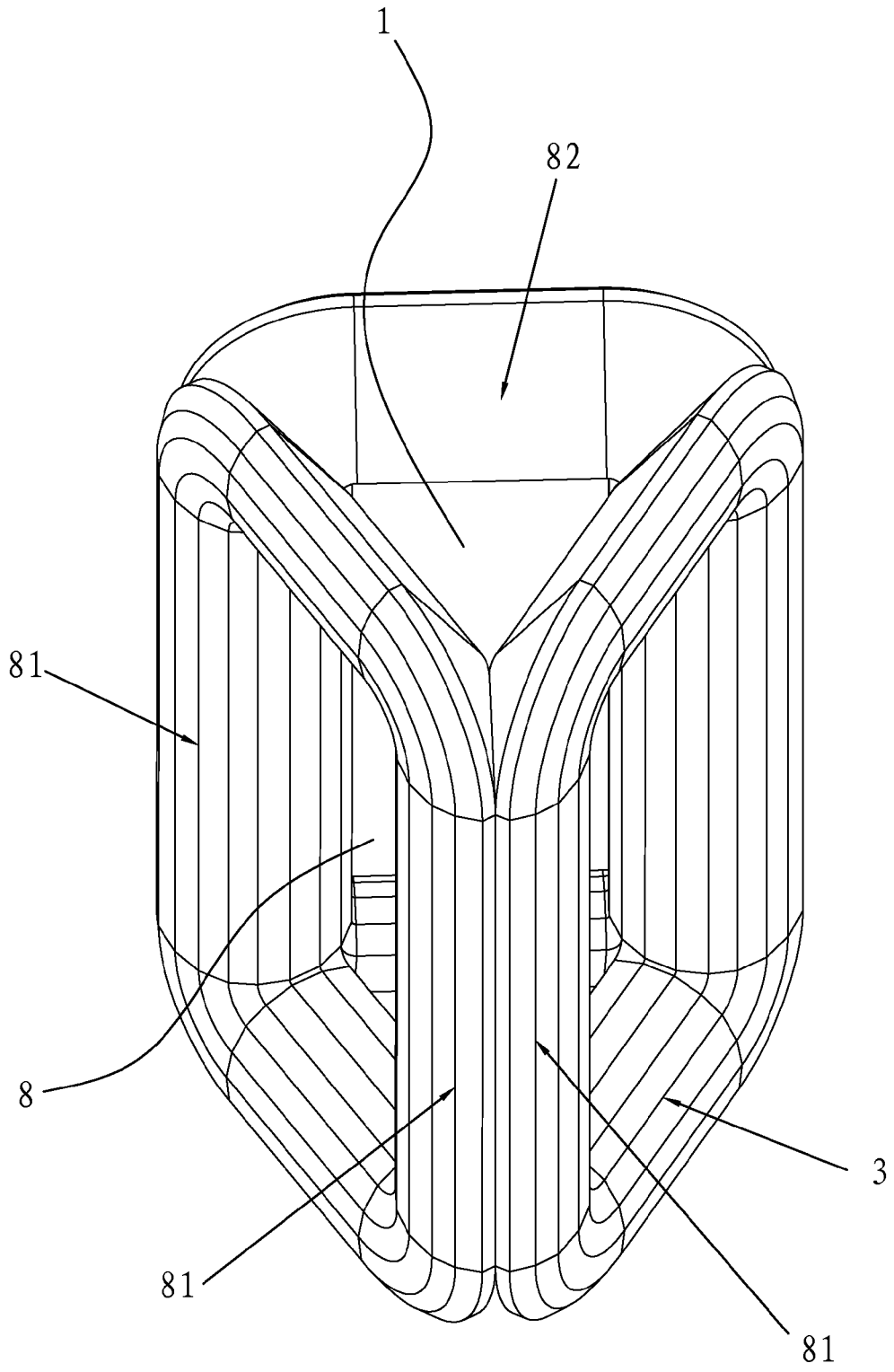
FIG. 3 a spatial view of core according to the invention.
Figure 4:
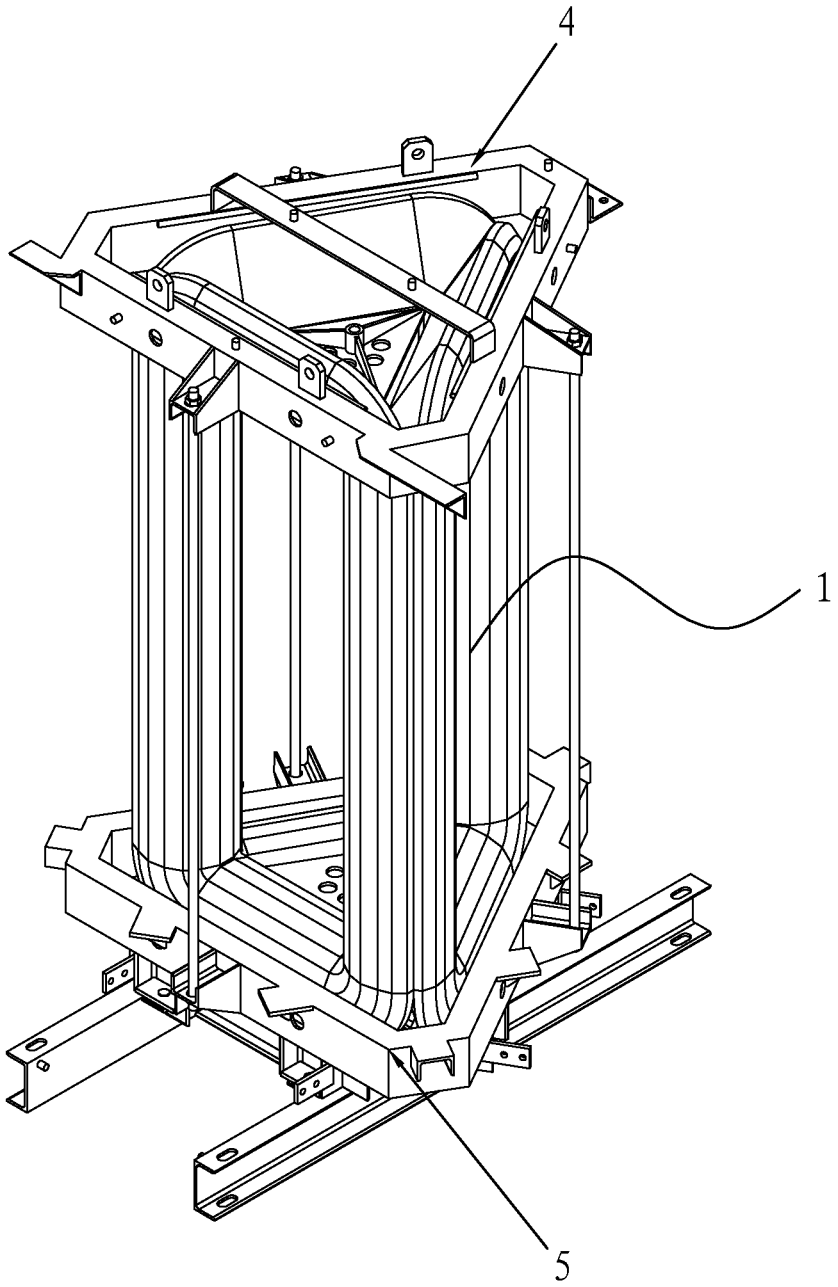
FIG. 4 is an assembly drawing of the clamp and core according to the invention.

As shown in FIGS. 1, 2 and 3, the resin-molded stereo wound-core dry-type amorphous alloy transformer provided in the present invention comprises a clamp, a core 1 and a winding, wherein the winding consists of three phase windings wound on the core pillars of the core1, each phase winding consists of a high-voltage winding 2 and a low-voltage winding 3.

As shown in FIG. 2, the clamp consists of an upper clamp 4, a lower clamp 5, an upper pressing board 61, a lower pressing board 62 and several press screws 7.

As shown in FIG. 3, the core 1 consists f three amorphous alloy made single frames 8, which are arranged annularly and every two adjacent of which are fixedly connected. The vertical sides 81 and horizontal sides 82 of the single frames are in a semi-circular or semi-regular-polygonal shape in cross section. The horizontal sides 82 form yokes, the vertical sides of every two adjacent single frames 8 are pieced together to form a core pillar, of which cross section is in a circular or regular-polygonal shape.

As shown in FIG. 2, the lower pressing board 62 is fixedly connected with a base 63 fixed on the lower clamp 5 through a supporting rod, the upper pressing board 61 and the lower pressing board 62 are cooperated with the press screws 7. The upper pressing board 61 is located on the top of the core 1, while the lower pressing board 62 is on the bottom of the core 1. In FIG. 2, the reference sign 51 indicates the portion for supporting the bottom padding blocks 10, and the reference sign 41 indicates the portion for compressing the upper padding blocks.

The yokes on the upper end of the core 1 are arranged between a side of the upper pressing board 81 and a side of the upper clamp 4, while the yokes on the lower end of the core 1 are arranged on the base 63 disposed between the lower press board 62 and the lower clamp 5. A damping device is provided between the yokes and the base 63, the device may be an elastic pad. With this structure, the core will no longer be subjected to the impacts of the redundant radial forces.

The high-voltage windings 2 and low-voltage windings 3 are arranged on the core pillars, the upper clamp 4 and the lower clamp 5 clamp the high-voltage windings 2 and the low-voltage windings 3 tightly.

The transformer further comprises upper padding blocks and lower padding blocks.

The upper padding blocks 9 and lower padding blocks 10 are arranged on the two ends of the high-voltage windings 2 and the low-voltage windings 3, respectively; the lower clamp 5 and lower pressing board 62 are configured to support the lower padding blocks 10, while the upper clamp 4 and the upper pressing board 61 are configured to compress the upper padding blocks 9.

Figure 5:
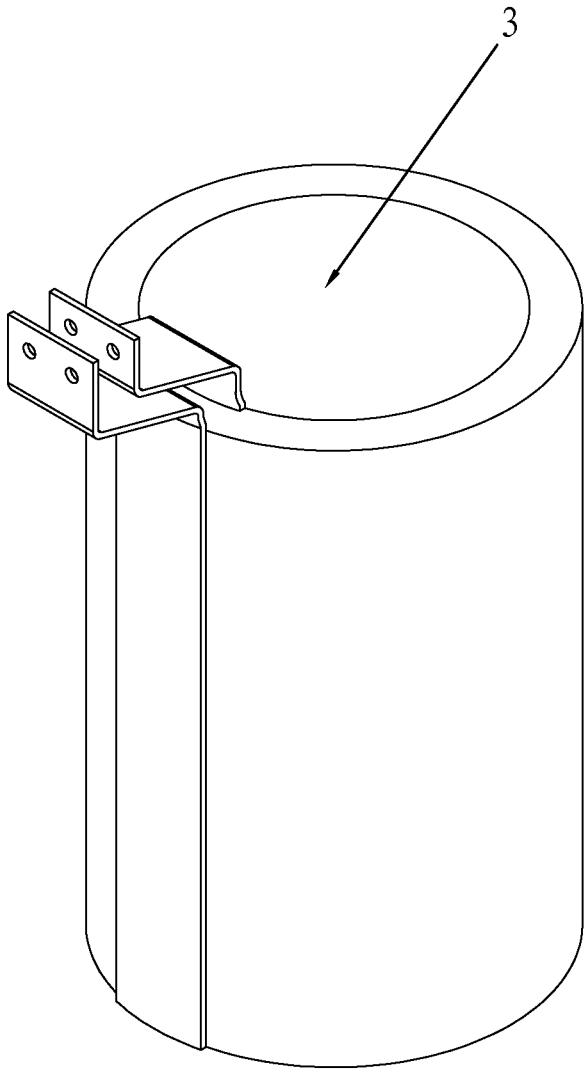
FIG. 5 is a spatial view of a foil-wound low-voltage winding according to the invention.

As shown in FIG. 5, the low-voltage windings 3 are with a foil-wound or wire-wound cylindrical structure, and the epoxy resin mixture is used therein for end sealing and isolation.

Figure 6:
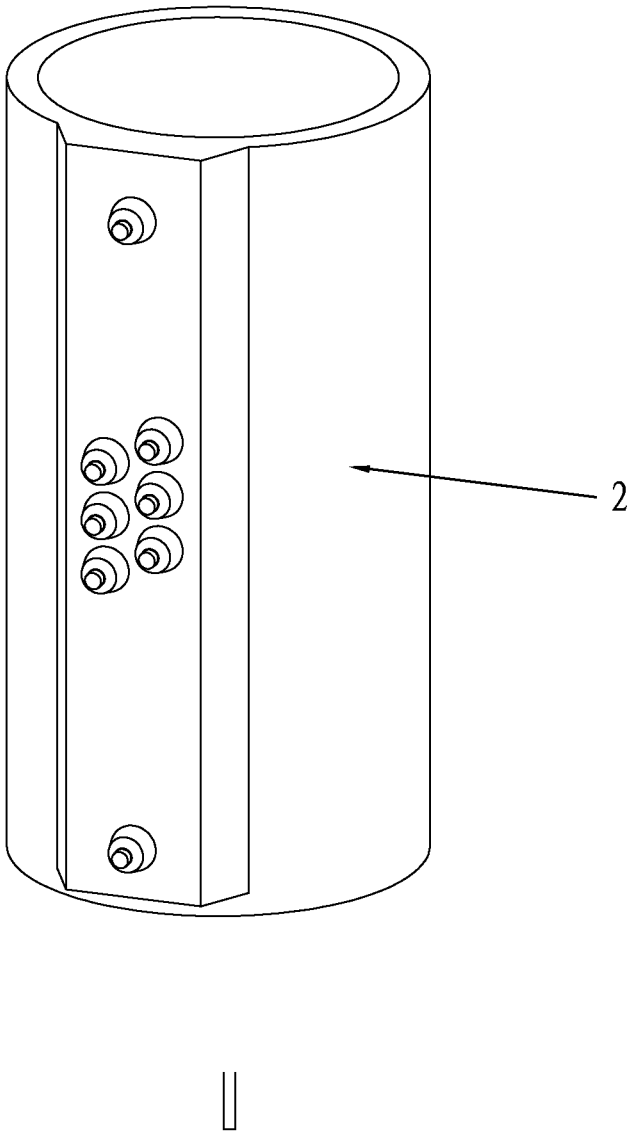
FIG. 6 is a spatial view of a high-voltage winding according to the invention.

As shown in FIG. 6, the high-voltage windings 2 are with a sectional-type cylindrical structure, and the windings are encapsulated entirely with a solid isolation layer of epoxy resin. The high-voltage windings are encapsulated with resin molded, the conductors and the resin insulation layer together form a complete rigid body with good mechanical strength.

A circular winding can fully realize its structural potentials, allowing the force to be evenly distributed on the conductor circumferentially, to overcome the shortcomings of the stress concentration and low mechanical strength caused by the rectangle structure of winding of the conventional amorphous alloy transformers and improve the ability of the transformer in short circuit withstanding. In addition, as the circular winding does not require any extra tools or equipment during its winding process, it is much easier for the exact size and elegant appearance of the winding to be guaranteed. Furthermore, the knocks during production which may damage the insulation of the conductors are avoided.

The transformer further comprises three connecting terminals 21, 22, 23 for the high-voltages 2 and four connecting terminals 31,32,33,34 for the low-voltage windings 3, which are arranged on the installation stands 11 of the upper clamp 4 at the opposite sides of the transformer.

While the invention has been described in terms of what are presently considered to be the most practical and preferred embodiments, it is to be understood that the invention need not be limited to the disclosed embodiments. On the contrary, it is intended to cover various modifications and similar arrangements included within the spirit and scope of the appended claims which are to be accorded with the broadest interpretation so as to encompass all such modifications and similar structure.

The invention claimed is:

1. A resin-molded stereo wound-core dry-type amorphous alloy transformer, comprising a clamp, a core and a winding, wherein the winding includes three phase windings wound on the core pillars of the core, each phase winding includes a high-voltage winding and a low-voltage winding, the clamp comprises an upper clamp, a lower clamp, an upper pressing board, a lower pressing board and press screws, wherein the core includes three amorphous alloy single frames which are arranged annularly and every two adjacent of which are fixedly connected, and the cross section of the vertical and horizontal sides of the single frames are in a semi-circular or semi-regular-polygonal shape, the horizontal sides of the single frames form yokes, and the vertical sides of every two adjacent single frames are fixedly connected to form one of the core pillars, the cross section of the core pillars are in an approximately circular or regular-polygonal shape;

the lower pressing board is fixedly connected with a base fixed on the lower clamp through a supporting rod, the upper and lower pressing boards are cooperated with the pressing screws, the upper pressing board is located on the top of the core, while the lower press board is located on the bottom of the core;

the yokes on the upper end of the core are arranged between a side of the upper pressing board and a side of the upper clamp, the yokes on the lower end of the core are arranged on the base located between the lower pressing board and the lower clamp;

the high-voltage windings and low-voltage windings are arranged on the core pillars, the upper and lower clamps clamp the high-voltage and low-voltage windings;

the transformer further comprises upper padding blocks and lower padding blocks;

the upper padding blocks and lower padding blocks are arranged on the two ends of the high-voltage and low-voltage windings respectively, the lower clamp and the lower pressing board are configured to support the lower padding blocks while the upper clamp and the upper pressing board are configured to compress the upper padding blocks;

the low-voltage windings are with a foil-wound or wire-wound cylindrical structure, in which an epoxy resin mixture is used for end sealing and isolation;

the high-voltage windings are with a sectional-type cylindrical structure; and encapsulated entirely with a solid isolation layer of epoxy resin;

an elastic pad is provided between the yokes and the base.

2. The resin-molded stereo wound-core dry-type amorphous alloy transformer according to claim 1, wherein the transformer further comprises three connecting terminals for the high-voltage windings and four connecting terminals for the low-voltage windings, which are arranged on the installation stands of the upper clamp at the opposite sides of the transformer.

3. A transformer, comprising:

a core including three amorphous alloy made single frames which are arranged annularly and every two adjacent of which are connected to each other, in which a cross section of vertical and horizontal sides of the single frames have a semi-circular or semi-regular-polygonal shape, and the horizontal sides of the single frames form yokes, and the vertical sides of every two adjacent single frames are connected to each other form core pillars, the cross section of the core pillars being an approximately circular or regular-polygonal shape, and a winding including three phase windings wound on the core pillars of the core, each phase winding including a high-voltage winding and a low-voltage winding.

* * * * *